US007604315B2

(12) United States Patent
Lowe et al.

(10) Patent No.: US 7,604,315 B2
(45) Date of Patent: Oct. 20, 2009

(54) METHOD FOR MAINTAINING PRINTHEAD PERFORMANCE

(75) Inventors: Tommy Otis Lowe, Lexington, KY (US); Randall David Mayo, Georgetown, KY (US); Michael Kelley Webb, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 54 days.

(21) Appl. No.: 11/548,346

(22) Filed: Oct. 11, 2006

(65) Prior Publication Data

US 2008/0088660 A1 Apr. 17, 2008

(51) Int. Cl.
*B41J 29/38* (2006.01)

(52) U.S. Cl. ..... 347/14; 347/7

(58) Field of Classification Search ..... 347/7, 347/17, 14, 19

See application file for complete search history.

(56) References Cited

U.S. PATENT DOCUMENTS 5,381,164 A 1/1995 Ono
5,721,573 A * 2/1998 Benjamin ..... 347/7
5,940,095 A 8/1999 Parish et al.
6,151,039 A * 11/2000 Hmelar et al. ..... 347/7
6,312,072 B1 * 11/2001 Hough ..... 347/7
6,431,686 B2 8/2002 Saul et al.
6,527,355 B1 3/2003 Yang et al.
6,570,601 B2 5/2003 Jimbo
6,595,610 B2 7/2003 Norton
6,601,936 B2 8/2003 McDonald
6,648,438 B1 11/2003 Tandou et al.
6,672,711 B2 1/2004 Kao et al.
6,848,764 B2 2/2005 Tang
7,219,972 B2 * 5/2007 Kanematsu et al. ..... 347/14
2005/0128233 A1 6/2005 Barkley et al.

* cited by examiner

*Primary Examiner*—Thinh H Nguyen
(74) *Attorney, Agent, or Firm*—IUSJURIS

(57) ABSTRACT

A method of operating an ink jet apparatus to print a print job on print media with a printhead having a supply of ink and an initial printhead operating frequency is disclosed. The method comprises receiving the print job for printing on the media, determining the volume of the supply of ink, comparing the volume of the supply of ink to a predetermined level, calculating a revised printhead operating frequency in response to the comparison, and operating the printhead at the revised printhead operating frequency to print the print job.

14 Claims, 5 Drawing Sheets

METHOD FOR MAINTAINING PRINTHEAD PERFORMANCE

CROSS REFERENCES TO RELATED APPLICATIONS

Reference is made to co-pending application Ser. No. 11/216,811, filed Aug. 31, 2005, for METHOD FOR CONTROLLING A PRINTHEAD.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an imaging apparatus, and more particularly, to a method for controlling a printhead to maintain a desired print quality and prevent runaway temperatures.

2. Description of the Related Art

In today's thermal inkjet industry, it is important in achieving acceptable print quality to supply a sufficient quantity of ink from an ink supply in an ink cartridge to a printhead during printing. If insufficient ink is supplied to the printhead, the printhead will print an unacceptably low quality image. This becomes very noticeable as the supply of ink in the ink cartridge approaches depletion, but is not empty. Even though sufficient ink remains in the cartridge for additional printing, the cartridge cannot be used to print acceptably, and the unit must be discarded, thus wasting the remaining ink.

The printhead must be operated at a desired operating temperature in order to ensure acceptable print quality. When the temperature is below the desired temperature, as, for example, when the printer is just switched on, the temperature may be increased by various methods. Once the printer has warmed up and is printing images, the ejection of the ink from the printhead serves to cool the printhead and prevent it from overheating. As long as the supply of ink is sufficient, the temperature of the printhead remains in the desired temperature range, and the printer achieves acceptable print quality. However, as the supply of ink drops, and insufficient ink is supplied to the printhead, the temperature can rise very quickly to unacceptable levels as the quantity of ink supplied decreases, thus experiencing a runaway temperature condition. If the printhead temperature is high enough, of course, the printhead can be ruined. Even if the high temperature does not ruin the printhead, the high temperature can significantly shorten the useful life of the printer and printhead.

It would thus be advantageous, when the ink supply drops to a low level but is not depleted, to supply sufficient ink to the printhead to maintain print quality, and prevent runaway printhead temperatures, thereby reducing the likelihood of damage to the printer.

SUMMARY OF THE INVENTION

The invention, in one exemplary embodiment, relates to a method for operating an ink jet apparatus to form an image on print media, the printhead having an initial printhead operating frequency and a supply of ink. The method includes receiving a print job for printing the image on the print media, determining the volume of the supply of ink, comparing the volume of the ink with a predetermined level, calculating a revised printhead operating frequency in response to the comparison, and operating the printhead at the revised printhead operating frequency to form the image on the print media.

The invention, in another exemplary embodiment, relates to a method of operating an ink jet apparatus to prevent runaway printhead temperatures. The ink jet apparatus has a printhead operating at an initial printhead operating frequency in a predetermined temperature range, and a supply of ink. The method includes receiving a print job for printing on print media, determining the volume of the supply of ink, comparing the volume of the supply of ink to a predetermined level, calculating a revised printhead operating frequency in response to the comparison, and operating the printhead at the revised printhead operating frequency to keep the printhead operating in the predetermined temperature range while printing the print job on the print media.

The invention, in yet another exemplary embodiment, relates to a method of operating an ink jet apparatus to form an image on print media. The ink jet apparatus has a printhead with an initial printhead operating frequency, a memory, and a supply of ink. The method includes receiving a print job for printing the image on the print media, determining the volume of the supply of ink, storing the volume of the supply of ink in the memory, comparing the volume of the supply of ink stored in the memory to a predetermined level, calculating a revised printhead operating frequency in response to the comparison, and operating the printhead at the revised printhead operating frequency to form the image on the print media.

BRIEF DESCRIPTION OF THE DRAWINGS

The above-mentioned and other features and advantages of this invention, and the manner of attaining them, will become apparent, and the invention will be better understood, by reference to the following description of embodiments of the invention taken in conjunction with the accompanying drawings, wherein.

DETAILED DESCRIPTION

Figure 1:
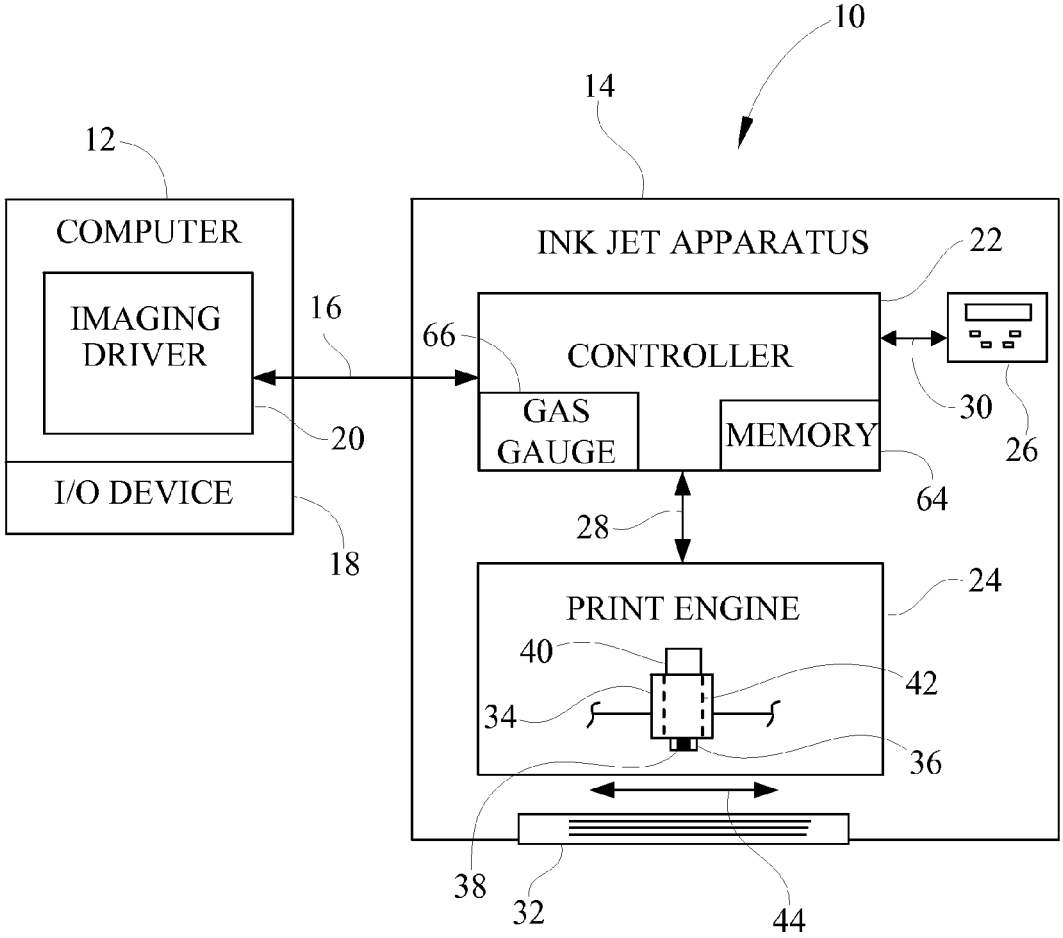
FIG. 1 is a diagrammatic depiction of a system embodying the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items. Unless limited otherwise, the terms "connected," "coupled," and "mounted," and variations thereof herein, are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, based on a reading of this detailed description, would recognize that, in at least one embodiment, the electronic based aspects of the invention may be implemented in software. As such, it should be noted that a plurality of hardware and software-based devices, as well as a plurality of different structural components, may be utilized to implement the invention. Furthermore, and as described in subsequent paragraphs, the specific mechanical configurations illustrated in the drawings are intended to exemplify embodiments of the invention, and that other alternative mechanical configurations are possible.

Referring to FIG. 1, there is shown a diagrammatic depiction of an imaging system 10 embodying the present invention. An imaging system 10 may include a computer 12 and an ink jet apparatus 14. The ink jet apparatus 14 communicates with the computer 12 via a communications link 16. The communications link 16 may be established by a direct cable connection, wireless connection or by a network connection, such as, for example, an Ethernet local area network (LAN).

Alternatively, the ink jet apparatus 14 may be a standalone unit that is not communicatively linked to a host, such as the computer 12. For example, the ink jet apparatus 14 may take the form of an all-in-one, i.e., a multifunction machine that includes standalone copying and facsimile capabilities, in addition to optionally serving as a printer when attached to a host, such as the computer 12. Additionally, the computer 12 could be replaced by a source of an image, such as a scanner, a camera, or a media card.

The computer 12 may be, for example, a personal computer including an input/output (I/O) device 18, such as a keyboard and display monitor. The computer 12 further includes a processor, input/output (I/O) interfaces, memory, such as RAM, ROM, NVRAM, and a mass data storage device, such as a hard drive, CD-ROM and/or DVD units. During operation, the computer 12 includes in its memory a software program including program instructions that function as an imaging driver 20, e.g., printer driver software, for the ink jet apparatus 14. Although, in the illustrated embodiment, the imaging driver 20 is depicted as residing in the computer 12, the imaging driver 20 is considered herein to be a part of the ink jet apparatus 14.

In the example of FIG. 1, the ink jet apparatus 14 also includes a controller 22, a print engine 24, and a user interface 26.

The imaging driver 20 of the computer 12 is in communication with the controller 22 of the ink jet apparatus 14 via the communications link 16. The imaging driver 20 facilitates communication between the ink jet apparatus 14 and the computer 12, and may provide formatted print data to the ink jet apparatus 14, and more particularly, to the print engine 24. Alternatively, however, all or a portion of the imaging driver 20 may be located in the controller 22 of the ink jet apparatus 14. For example, where the ink jet apparatus 14 is a multifunction machine having standalone capabilities, the controller 22 of the ink jet apparatus 14 may include an imaging driver 20 configured to support a copying function, and/or a fax-print function, and may be further configured to support a printer function. In the present embodiment, the imaging driver facilitates the communication of formatted print data, as determined by a selected print mode, to the print engine 24.

The controller 22 includes a processor unit and associated memory, and may be formed as an Application Specific Integrated Circuit (ASIC). The controller 22 communicates with the print engine 24 via a communications link 28. The controller 22 communicates with the user interface 26 via a communications link 30. The communications links 28 and 30 may be established, for example, by using standard electrical cabling or bus structures, or by wireless connection.

The print engine 24 may be, for example, an ink jet print engine configured for forming an image on a sheet of print media 32, such as a sheet of paper, transparency or fabric.

Figure 2:
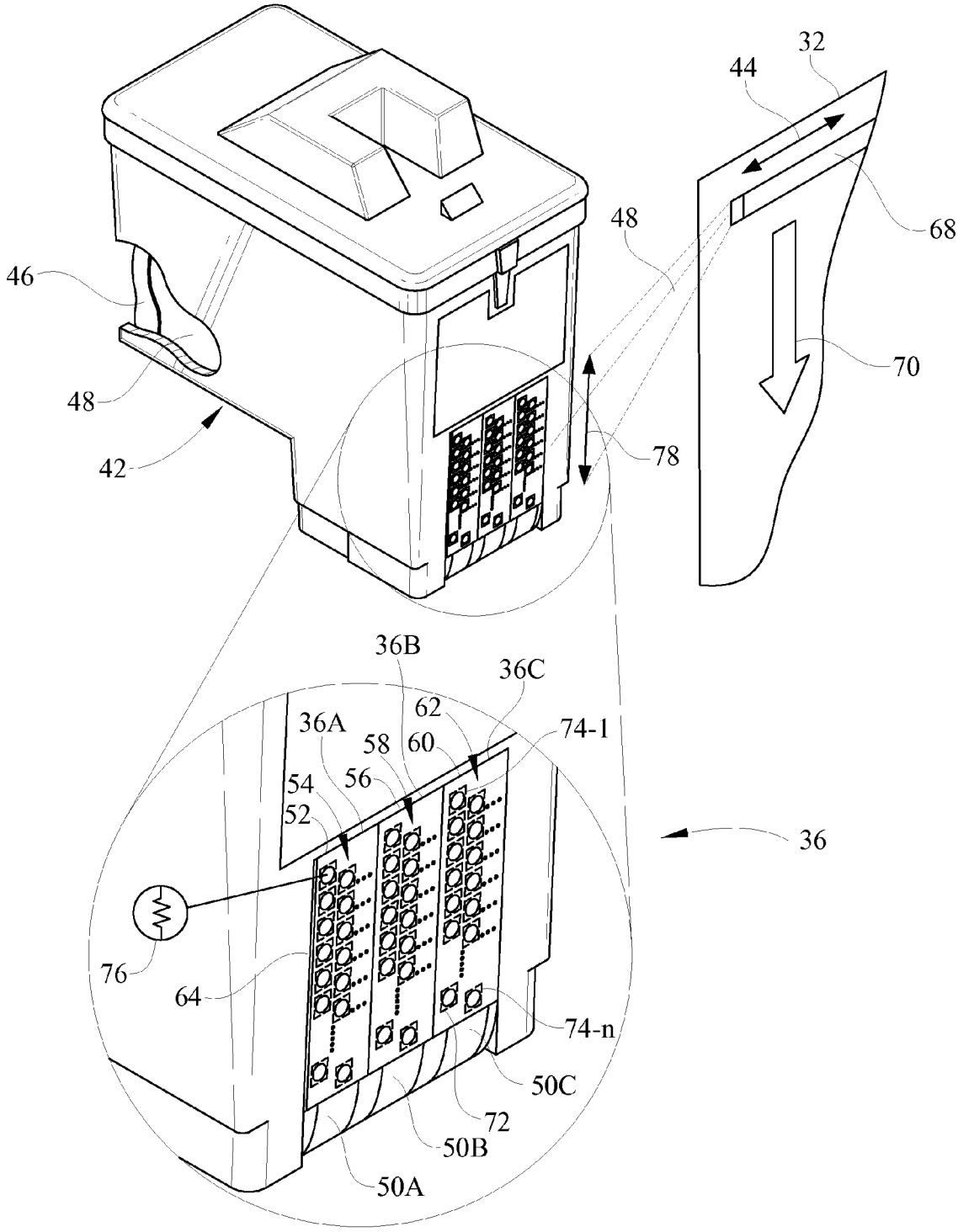
FIG. 2 is a cutaway, perspective view of the printhead of FIG. 1, with the printhead being projected over a sheet of print media.

The print engine 24 may include, for example, a reciprocating printhead carrier 34, and at least one ink jet printhead 36 having at least one printhead temperature sensor 38, for example, the printhead temperature sensors 50A, 50B, and 50C (see FIG. 2). A power supply 40 is associated with the printhead 36 and supplies electrical signals to the printhead 36 for printhead warming, and for ink ejection during printing operations. The power supply 40 is depicted in FIG. 1 as being adjacent to the cartridge 42 associated with the printhead 36 for purposes of illustration. It may, however, be located at any convenient location, provided that the power supply 40 is communicatively coupled to the printhead 36.

The printhead carrier 34 transports the ink jet printhead 36 and the printhead temperature sensor 38 in a reciprocating manner in a bi-directional main scan direction 44 over an image surface of a sheet of the print media 32 during printing and/or sensing operations at a predetermined carrier speed. This carrier speed is initially set at the time of manufacture of the ink jet apparatus 14, and may be a speed such as 30 inches per second.

The printhead carrier 34 may be mechanically and electrically configured to mount, carry and facilitate one or more printhead cartridges 42, such as a monochrome printhead cartridge and/or one or more color printhead cartridges. Each printhead cartridge 42 may include, for example, an ink reservoir 46 containing a supply of ink 48, to which at least one respective printhead 36 is attached (See FIG. 2.) In order for the print data from the computer 12 to be properly printed by the print engine 24, the data generated by the computer 12 is converted into data compatible with the print engine 24 and the printhead(s) 36.

Referring now to FIG. 2, in the present embodiment, a single printhead, such as the printhead 36, includes a plurality of ink ejectors and a plurality of addresses employed for ejecting ink from the ink ejectors, wherein each address corresponds to a particular subset of the plurality of ink ejectors. The printhead 36 also includes multiple regions, each region having an ink jetting array, with each array associated with one color of a plurality of colors of ink, for example, regions 36A, 36B, and 36C, corresponding to cyan, yellow, and magenta inks, respectively. Alternatively, it is contemplated that each array may also be associated with one type of ink of a plurality of types of inks. In another embodiment, the printhead carrier 34 may be configured to carry multiple printheads 36, wherein each printhead 36 pertains to a different color, saturation, and/or ink type, wherein each color, saturation, and/or ink type may constitute a region. For example, in a system using cyan, magenta, yellow and black inks, the printhead carrier 34 may carry four printheads 36, with each printhead 36 carrying an ink ejector array dedicated to a specific color of ink, e.g., cyan, magenta, yellow and black.

It will be understood that the regions of the printhead 36, e.g., the regions 36A, 36B, and 36C or other designated regions, are not limited to an associated ink color or ink type, but rather, may be any region of the printhead 36.

In the present embodiment, the printhead temperature sensors 50A, 50B, and 50C measure the temperature of the regions 36A, 36B, and 36C, respectively. Temperature data from the printhead temperature sensors 50A, 50B, and 50C are employed to control and maintain the temperature of the regions 36A, 36B, and 36C, respectively, of the printhead 36. Other configurations are possible, of course, such as a single thermal sensor positioned on a silicon chip or an associated area with significant thermal coupling.

An exemplary configuration of the printhead 36 includes a cyan nozzle plate 52 corresponding to a cyan ink ejector array or nozzle 54, a yellow nozzle plate 56 corresponding to a yellow ink ejector array or nozzle 58, and a magenta nozzle plate 60 corresponding to a magenta ink ejector array or nozzle 62, for respectively ejecting cyan (C) ink, yellow (Y) ink, and magenta (M) ink. In the present embodiment, the cyan ink ejector array 54, yellow ink ejector array 58, and magenta ink ejector array 62 correspond to the regions 36A, 36C, and 36B, respectively.

The printhead 36 may include a printhead memory 64 for storing information relating to the printhead 36 and/or ink jet apparatus 14, such as the level of ink 48 in the reservoir 46. For example, the memory 64 may be formed integrally with the printhead 36, or may be attached to the printhead cartridge 42.

The controller 22 includes an ink level measurement gauge or gas gauge 66 (see FIG. 1) for measuring the level of ink 48 in the reservoir 46. The ink level measurement gauge 66 is sometimes referred to as the gas gauge 66, as it is analogous to the fuel level indicator in an automobile. The ink level measurement gauge 66 may be a routine stored in the controller 22 of the ink jet apparatus 14.

As further illustrated in FIG. 2, the controller 22 controls the printhead carrier 34 to move the printhead 36 in a reciprocating manner in the main scan direction 44, with each left to right, or right to left, movement of the printhead carrier 34 along the main scan direction 44 over the sheet of print media 32 being referred to herein as a pass. The area traced by the printhead 36 over the sheet of print media 32 for a given pass will be referred to herein as a swath 68, such as for example, the swath 68 shown in FIG. 2. The sheet of print media 32 may be advanced between passes in a media feed direction 70.

It will be appreciated by those of skill in the art that the ink jet apparatus 14 may be operated in a plurality of print quality modes. For example, the ink jet apparatus 14 may be operated in a "draft" quality mode, a "normal" quality mode, or a "best" quality mode. The controller 22 causes the ink jet apparatus 14 to transport the printhead 36 multiple times across the sheet of print media 32 for each swath 68 of each print quality mode, with more passes for the higher quality settings. It will be understood that the nozzles 54, 58, 62 eject ink onto the sheet of print media 32, but not all of the nozzles 54, 58, 62 eject ink on each pass of the printhead 36. Thus, one nozzle 54, for example, may eject ink 48 on the first and fourth passes of the printhead 36 when operated in best print quality mode, but not on any of the other passes of the printhead 36.

In the ink ejector configuration for the ink jet printhead 36 shown in FIG. 2, each of the ink ejector arrays 54, 58, 62 includes a plurality of ink ejectors 72, with each ink ejector 72 having a nozzle 74, and having at least one corresponding jetting heater 76.

A swath height 78 of the swath 68 corresponds to the distance between the uppermost and lowermost of the nozzles within an array of nozzles of the printhead 36. For example, in the magenta ink ejector array 62, the nozzle 74-1 is the uppermost nozzle and nozzle **74-*n* is the lowermost nozzle. In the example of FIG. 2, the swath height 78 is the same for each of the ink ejector arrays 54, 58, 62; however, this need not be the case, i.e., it is possible that the swath heights 78 of the ink ejector arrays 54, 58, 62** may be different and include fewer nozzles or be subset range of the nozzles between uppermost and lowermost nozzles within each array, either by design or due to manufacturing tolerances.

Figure 3:
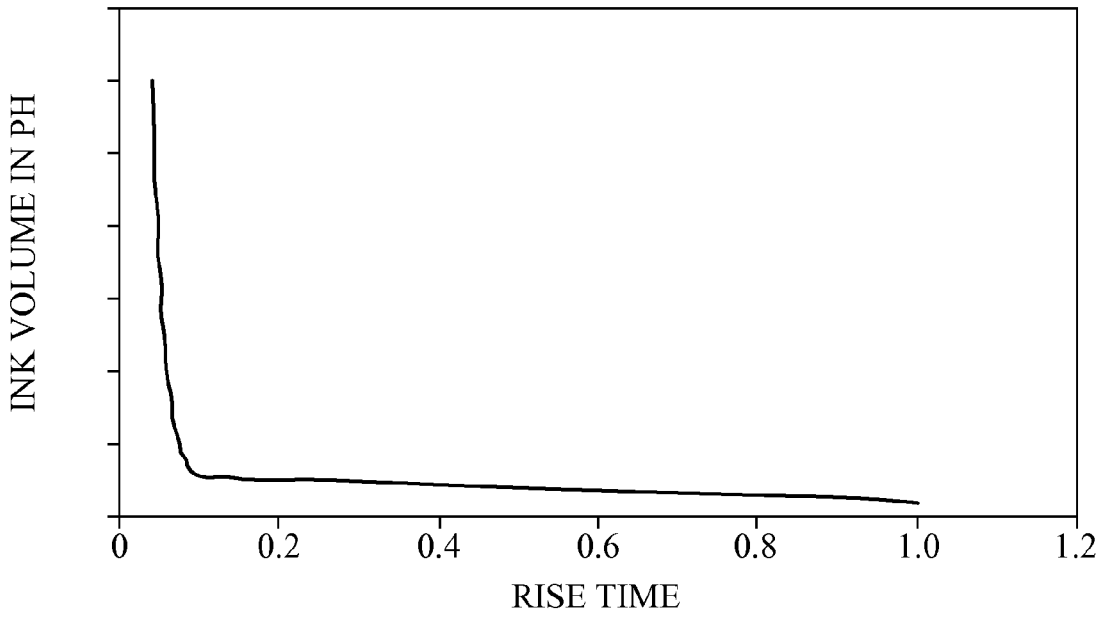
FIG. 3 is a diagram depicting ink volume versus rise time in a printhead.

Persons of ordinary skill in the art will recognize that a finite amount of time, called rise time, is required for the ink 48 to flow from the reservoir 46 to the nozzle 54, 58, 62 after the ejection of a drop of ink 48. When a plentiful supply of ink 48 is in the reservoir 46, the rise time could be approximately 50 to 60 μsec. Other times, of course, are also possible. From FIG. 3, it will be appreciated that, as the ink volume in the reservoir 46 decreases and approaches a very low level, the rise time required to fill the nozzles 54, 58, 62 significantly increases. This increase in rise time holds true whether the ink volume decrease is because of loss is due to evaporation of the ink 48 or due to be use in printing sheets of the print media 32.

The ink jet apparatus 14 allows the nozzles 54, 58, 62 to refill according to the printhead operating frequency. The printhead operating frequency is a function of the ink jet apparatus 14 and the selected print quality mode. The initial printhead operating frequency is determined upon the manufacture of the printhead 36, is a maximum possible frequency, and is calculated with an understanding that the reservoir 46 is filled with ink 48.

The horizontal resolution of the ink jet apparatus 14 is the maximum distance between drops, if the printhead 36 is fired one time, at every address opportunity, as it passes over the sheet of print media 32. In one common embodiment, 600 dots per inch is a common resolution.

The printhead operating frequency of the ink jet apparatus 14 may thus be defined as: Horizontal Resolution×Carrier Speed.

It will thus be appreciated that the printhead operating frequency is directly proportional to the carrier speed, and that this represents a maximum speed for the printhead 36; in certain instances, the printhead 36 can operate at less than the maximum speed.

With an exemplary carrier speed of 30 inches per second, the printhead operating frequency is:

600 (Dots/Inch)×30 Inch/Second=18000 Dots/Second=18000 Hz.

With a carrier speed of 20 inches per second, or a speed somewhat slower than previously discussed, the printhead operating frequency is:

600 (Dots/Inch)×20 Inch/Second=12000 Dots/Second=12000 Hz.

When the ink jet apparatus 14 is operated at a printhead operating frequency of 18 KHz, there is 1/18 Khz=55 μsec. of time available for each nozzle 54, 58, 62 to refill. It will be appreciated that this time period is determined by the operating speed of the ink jet apparatus 14 and is not a function of the actual rise time of the nozzles 54, 58, 62. It will be further appreciated that if the rise time of the nozzles 54, 58, 62 is greater than 55 μsec., insufficient time will be available for the nozzles 54, 58, 62 completely to fill with ink 48, and, thus, the ink volume in each drop 48 ejected by the nozzles 54, 58, 62 will be less than desired.

It will be noted that the rise time imposed for an individual nozzle is also dependant upon the selected print quality mode.

For the example, the time of 55 μsec. is the minimum time, for a single nozzle 54, 58, 62, under full density printing, at 18 Khz. A typical example, for the printhead 36, is a large font, mono text, print job printed in draft quality print mode.

One undesirable consequence of a prolonged increase in the rise time of the ink jet apparatus 14 is a significant reduction in print quality. When the nozzles 54, 58, 62 are not filled with enough ink, the printed image will be lighter than desired. It will be appreciated that in an instance where the rise time is very much greater than the printhead operating frequency, no ink may be ejected from the nozzles 54, 58, 62, resulting in no image being printed on the print media 32. This occurs even though sufficient ink 48 remains in the reservoir 46 to print an image.

Figure 4:
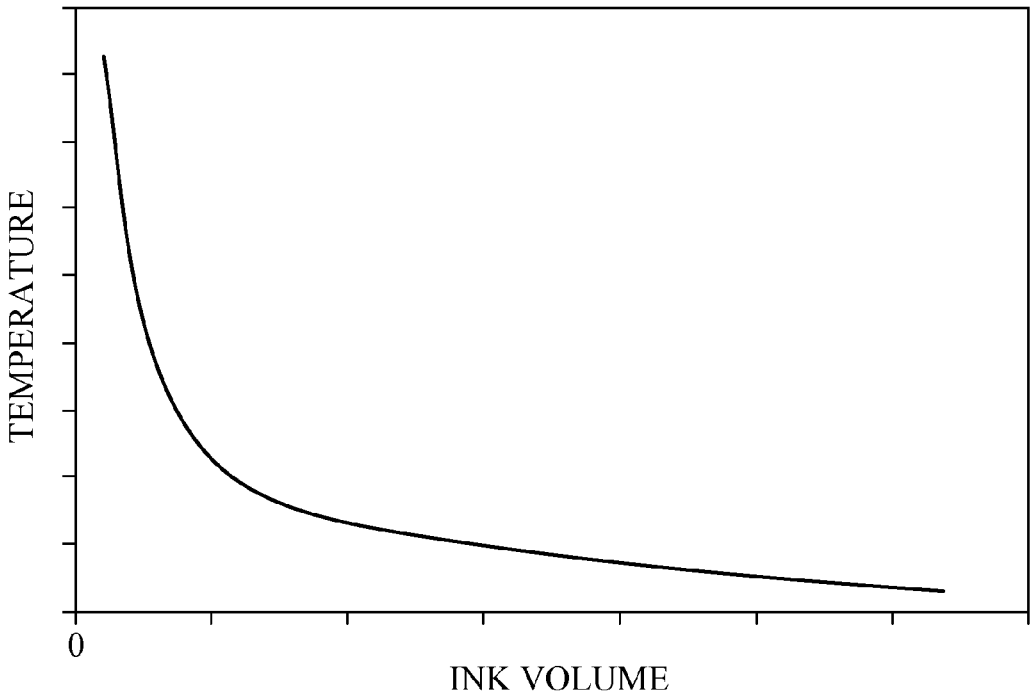
FIG. 4 is a diagram depicting temperature versus ink volume in a printhead.

Another undesirable consequence of a prolonged increase in the rise time of the ink jet apparatus 14 is a significant, damaging increase in printhead temperature. The ink jet apparatus 14 uses known thermal control algorithms to keep the temperature of the printhead 36 within acceptable limits, as well as thermal dissipation through the printhead 36 and air convection. These algorithms regulate the printhead temperature by controlling heating and by inserting appropriate time delays in the path of travel of the printhead carrier 34. It will be appreciated, however, that the printhead 36 also relies upon the ejection of drops for cooling within the swath 68. The drops carry heat away from the printhead 36, just as in any liquid cooled device. If the size or mass of a drop of ink 48 is reduced, or worse, if the size is zero, the temperature of the printhead 36 increases very rapidly in a runaway temperature condition. Reference may be had to FIG. 4, which illustrates that, as the size of a drop of ink 48 approaches zero, the printhead temperature quickly increases to a very high level in a runaway temperature condition.

The printhead 36, when experiencing a greatly reduced decline in the size of the drops of ink 48, can easily exceed its maximum acceptable temperature. The runaway temperature in such an instance may become so high as to cause significant damage to critical printer components due to thermal deformation.

The risk for damage to the printhead 36 from runaway temperatures is greatest when the size of the drop of ink 48 is zero across the printhead 36, such as when the ink reservoir 46 is completely empty.

Figure 5:
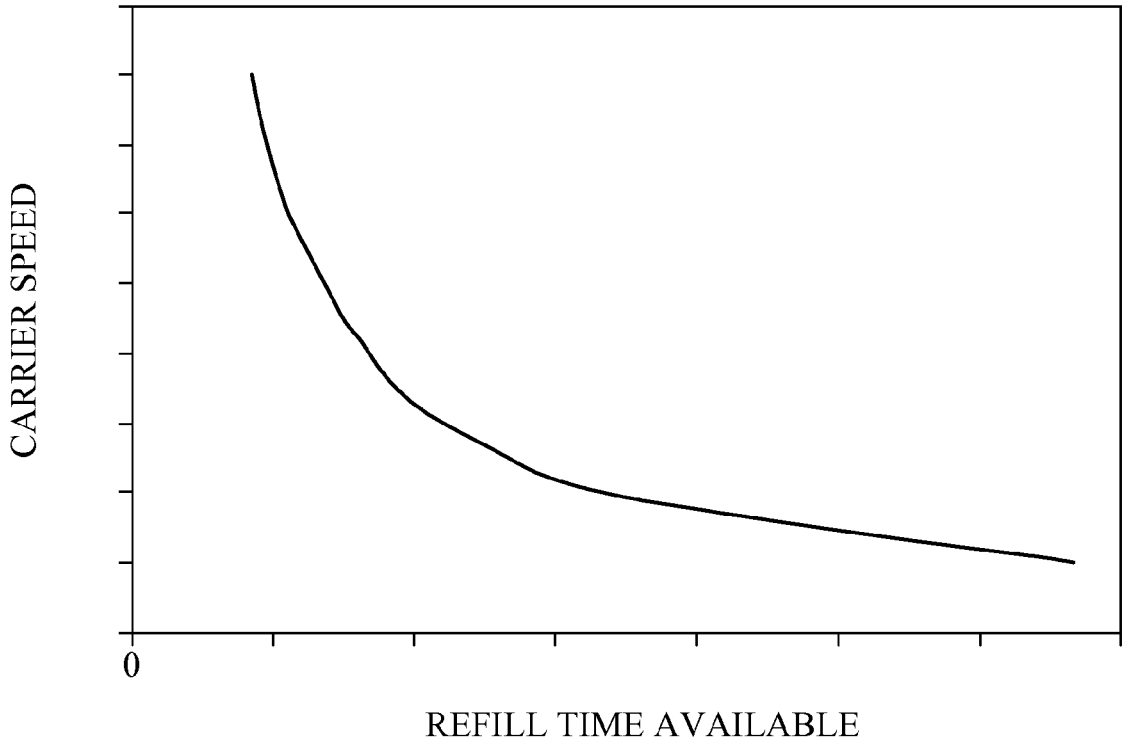
FIG. 5 is a diagram depicting carrier speed versus refill time available in a printhead.

FIG. 5 illustrates how, as carrier speed decreases, the refill time available for the nozzles 54, 58, 62 increases.

In the ink jet apparatus 14 operated in accord with the present invention, as the volume of the drops of ink 48 approach zero, the printhead operating frequency is lowered from its initial or maximum printhead operating frequency to a revised printhead operating frequency, thereby allowing a drop of ink 48 to be ejected with a greater volume or size. The revised printhead operating frequency improves the quality of the image formed on the print media 32, because the longer time provided by the lower printhead operating frequency accommodates the slower rise time of the almost depleted reservoir 46. The revised printhead operating frequency limits the temperature of the printhead by allowing more time for heat to dissipate into thermal paths in addition to the ink 48, thus preventing runaway temperatures and providing a superior operating life for the printhead 36. As noted hereinbefore, the amount or volume of ink remaining in the reservoir 46 for the printhead 36 is calculated with the ink level measurement gauge 66, and the measurement is stored in the memory 64. The amount or volume of ink remaining in the reservoir 46 for the printhead 36 may be stored unalterably or permanently in the memory 64, so that it cannot be altered or changed. The printhead operating frequency calculated from the ink level measurement stored in the memory 64 thus ensures that the printhead 36 will not operate at its initial printhead operating frequency again. Calculating the revised printhead operating frequency from the ink level measurement stored in the memory 64 insures that the printhead 36 delivers the best possible print quality, even if the printhead 36 is removed and reinstalled, or installed in a different ink jet apparatus 14.

When the ink 48 in the reservoir 46 is reduced to a predetermined level, the printhead operating frequency is reduced to the revised printhead operating frequency. The calculation of the revised printhead operating frequency is proportional to the ink 48 remaining in the reservoir 46. When the ink level measurement gauge 66 indicates that the reservoir 46 is almost depleted, the initial possible printhead operating frequency is lowered to the revised printhead operating frequency to avoid excessive heating of the printhead 36. The printhead operating frequency can be lowered by any amount up to 5 KHz, for example. The decrease in the printhead operating frequency ensures that the ink jet apparatus 14 prints the best available print quality as long as an amount of ink 48 remains in the reservoir 46. The decrease in printhead operating frequency also prevents overheating of the printhead 36, and thus, insures a long life for the printhead 36. It will be appreciated that if the printhead 36 becomes very hot, it may damage portions of ink jet apparatus 14; for example, it might melt rubber caps positioned in a maintenance station of the ink jet apparatus 14 (not shown), thus damaging the ink jet apparatus 14.

The initial printhead operating frequency may be reduced to the revised printhead operating frequency by reducing the carrier speed, via firmware, or by increasing the number of passes of the printhead 36 by the print quality mode selection by the driver 20. For example, a job normally executed in a draft mode, wherein the printhead 36 makes one pass for each swath 68, can be printed in normal mode, wherein the printhead 36 makes four passes for each swath 68 for example. In such an instance, it will be appreciated that each nozzle 54, 58, 62 will operate less frequently than in the selected draft mode, thus providing more time for the ink 48 to fill the nozzles 54, 58, 62. It will be further appreciated that as the ink 48 in the reservoir 46 is further depleted, a draft quality print mode job, in which only one pass of the printhead 36 is made for each swath 68, may be printed in best quality print mode, in which the printhead 36 makes sixteen passes for each swath 68 for example. The number of passes used for normal mode and best quality mode of printing varies depending on the design of the ink jet apparatus 14 and the imaging driver 20.

The high level of shingling present in a print job with multiple passes for each swath 68 also reduces the likelihood that a particular nozzle 54, 58, 62 will be employed in frequent succession in a print job.

Persons of ordinary skill in the art will recognize that, once the printhead operating frequency has been reduced as much as is practical to support good print quality, pauses may also be inserted at the end of each pass by the carrier 34 to assist in controlling the printhead temperature.

Figure 6:
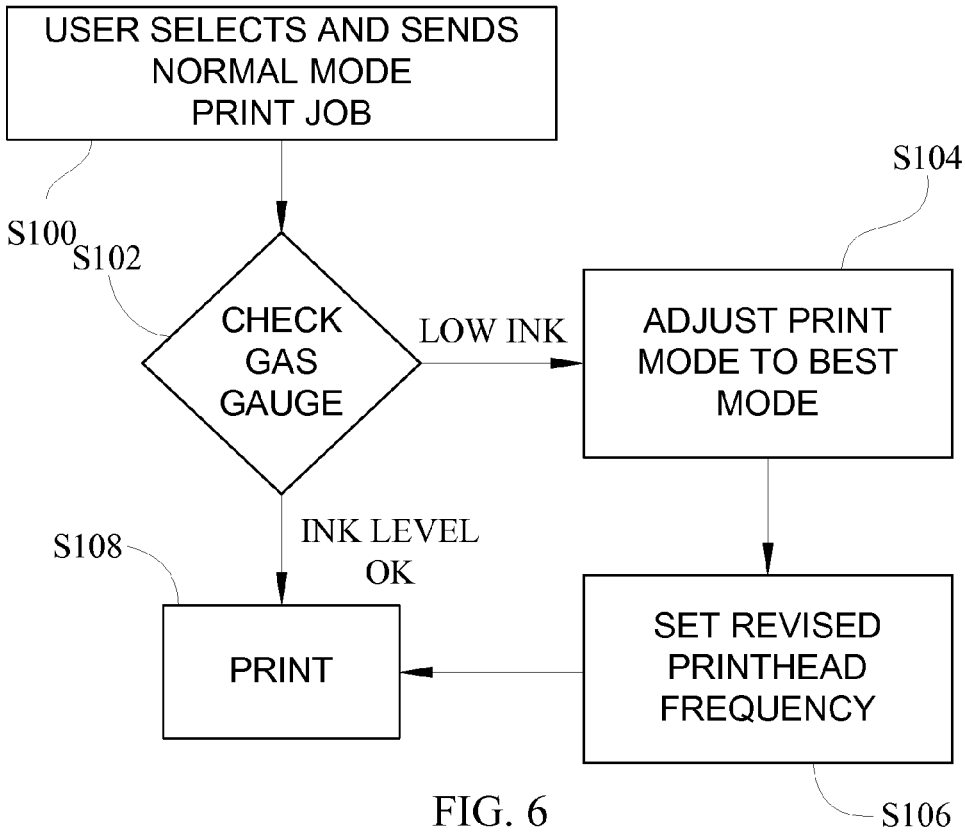
FIGS. 6 and 7 are flowcharts depicting a method for controlling a printhead in accordance with the present invention.
Figure 7:
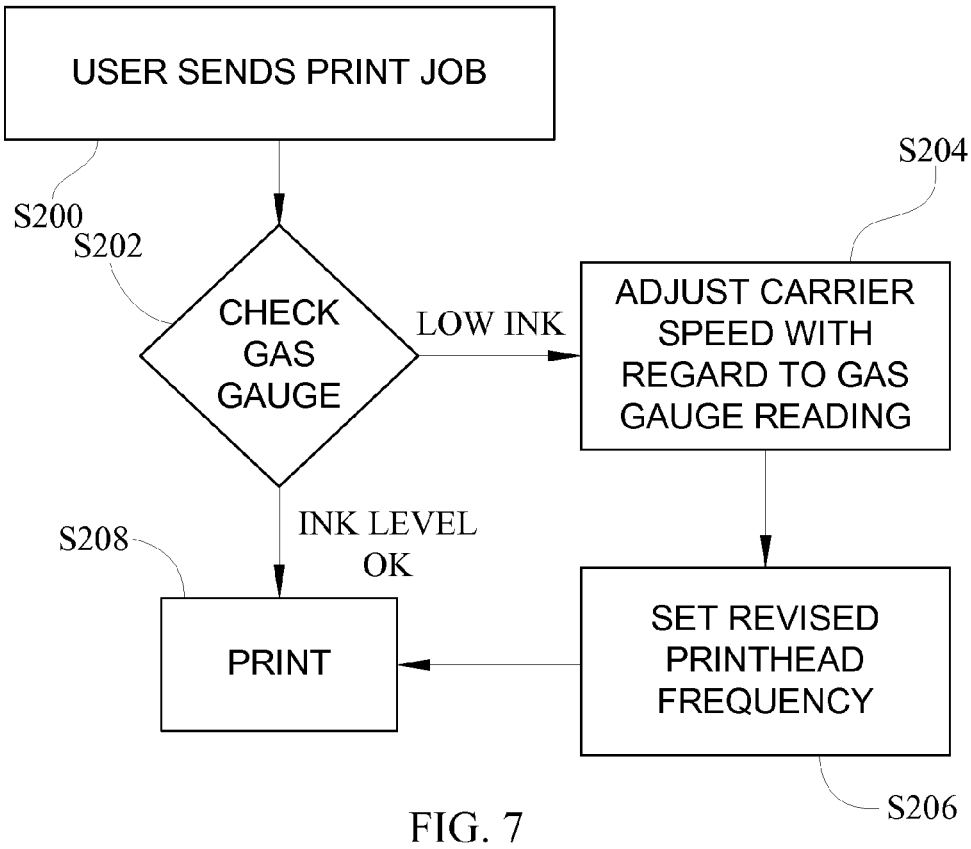

Referring now to FIGS. 6 and 7, a method for controlling the printhead 36 for printing and maintaining a desired print quality during printing in accordance with the present invention is depicted. Unless otherwise indicated, each step is performed by the controller 22 executing program instructions, for example, as part of the imaging driver 20.

At step S100 of FIG. 6, a user executes a print command to print a document, for example, using conventional word or image processing software operating on the computer 12. In the most usual case, the user selects the normal print quality mode.

At step S102, a test is performed with the ink level measurement gauge 66 to determine the current level of the ink 48 in the reservoir 46.

At step S104, if the ink level measurement gauge 66 is low, as determined in step S102, the print quality mode is adjusted to a higher print quality setting, such as the best quality mode.

At step S106, the revised printhead operating frequency of the printhead 36 is set to correspond to the low ink level in the reservoir 46.

At step S108, the ink jet apparatus 14 prints the job on the print media 32.

At step S200 of FIG. 7, a user executes a print command to print a document, for example, using conventional word or image processing software operating on the computer 12. Unlike the method of FIG. 6, however, the method of FIG. 7 does not require the user to select a particular print quality mode.

At step S202, a test is performed with the ink level measurement gauge 66 to determine the current level of the ink 48 in the reservoir 46.

At step S204, if the ink level measurement gauge 66 is low, as determined in step S202, the carrier speed is adjusted to a lower speed.

At step S206, the revised printhead operating frequency of the printhead 36 is set to correspond to the low ink level in the reservoir 46.

At step S208, the ink jet apparatus 14 prints the job on the print media 32.

The disclosed method assures that the printhead 36 will delivers the best possible print quality, and operates at acceptable temperatures, even if the printhead 36 is removed and reinstalled, or installed in a different ink jet apparatus 14.

The foregoing description of several methods and an embodiment of the invention have been presented for purposes of illustration. It is not intended to be exhaustive or to limit the invention to the precise steps and/or forms disclosed, and many modifications and variations are possible in light of the above teaching. It is intended that the scope of the invention be defined by the claims appended hereto.

What is claimed is:

1. A method of operating an ink jet apparatus to form an image on print media, said ink jet apparatus having a printhead with an initial printhead operating frequency and a supply of ink, comprising:

receiving a print job for forming said image on said print media;

determining the volume of said supply of ink;

comparing said volume of said supply of ink to a predetermined level, said predetermined level being independent of a current operating temperature of said printhead;

calculating a revised printhead operating frequency in response to the comparison;

operating said printhead at said revised printhead operating frequency to form said image on said print media, wherein said revised printhead operating frequency is lower than said initial printhead operating frequency when said volume of said supply of ink is lower than said predetermined level; and storing said determination of said volume of said supply of ink in a memory when said volume of said supply of ink is lower than said predetermined level, wherein the storing step includes unalterably storing said determination of said volume of said supply of fink in said memory so that said determination of said volume of said supply of ink cannot be changed.

2. The method of claim 1, wherein the quality of said image formed on said print media degrades when said printhead is operated at said initial printhead operating frequency and said volume of said ink is below said predetermined level, and wherein said revised printhead operating frequency is calculated to improve said quality of said image formed on said print media when said volume of said ink is below said predetermined level.

3. The method of claim 1, wherein said ink jet apparatus has a printhead carrier for transporting said printhead at a predetermined carrier speed in a reciprocating manner in a bi-directional main scan direction over said print media, and wherein said printhead operates at an initial carrier speed associated with said initial printhead operating frequency, and wherein said printhead operates at a revised carrier speed associated with said revised printhead operating frequency, said revised carrier speed being slower than said initial carrier speed.

4. The method of claim 1, wherein said ink jet apparatus has a printhead carrier for transporting said printhead in at least one pass in a reciprocating manner in a bi-directional main scan direction over said print media, and wherein said printhead operates in a plurality of print quality modes, wherein said printhead makes a predetermined number of passes over said print media in each of said print quality modes, with higher quality print modes having more passes than lower quality print modes, and wherein said printhead operates in a higher quality print mode in said revised printhead operating frequency to increase the number of passes made by said printhead over said print media.

5. A method of operating an ink jet apparatus to prevent runaway printhead temperatures, said ink jet apparatus having a printhead operating at an initial printhead operating frequency, a printhead temperature in a predetermined temperature range, and a supply of ink, comprising:

receiving a print job for printing on print media;

determining the volume of said supply of ink;

comparing said volume of said supply of ink to a predetermined level, said predetermined level being independent upon a current operating temperature of said printhead;

calculating a revised printhead operating frequency in response to the comparison;

operating said printhead at said revised printhead operating frequency to keep said printhead operating in said predetermined temperature range while printing said print job on said print media, wherein said revised printhead operating frequency is lower than said initial printhead operating frequency when said volume of said supply of ink is lower than said predetermined level; and storing said determination of said volume of said supply of ink in a memory when said volume of said supply of ink is lower than said predetermined level, wherein the storing step includes permanently storing said determination of said volume of said supply of fink in said memory so that said determination of said volume of said supply of ink cannot be changed.

6. The method of claim 5, wherein said ink jet apparatus has a printhead carrier for transporting said printhead at a predetermined carrier speed in a reciprocating manner in a bi-directional main scan direction over said print media, and wherein said printhead operates at an initial carrier speed associated with said initial printhead operating frequency, and wherein said printhead operates at a revised carrier speed associated with said revised printhead operating frequency, said revised carrier speed being slower than said initial carrier speed.

7. The method of claim 5, wherein said ink jet apparatus has a printhead carrier for transporting said printhead in at least one pass in a reciprocating manner in a bi-directional main scan direction over said print media, and wherein said printhead operates in a plurality of print quality modes, wherein said printhead makes a predetermined number of passes over said print media in each of said print quality modes, with higher quality print modes having more passes than lower quality print modes, and wherein said printhead operates in a higher quality print mode in said revised printhead operating frequency to increase the number of passes made by said printhead over said print media.

8. A method of operating an ink jet apparatus to form an image on print media, said ink jet apparatus having a printhead with an initial printhead operating frequency, a memory, and a supply of ink, comprising:

receiving a print job for forming said image on said print media;

determining the volume of said supply of ink;

storing said volume of said supply of ink in said memory;

comparing said volume of said supply of ink stored in said memory to a predetermined level, said predetermined level being independent of printhead temperature;

calculating a revised printhead operating frequency in response to the comparison, said calculating being independent of current printhead temperature; and operating said printhead at said revised printhead operating frequency to form said image on said print media, wherein the storing step further comprising unalterably storing said determination of said volume of said supply of ink in said memory so that said determination of said volume of said supply of ink cannot be changed when said volume of said supply of ink is lower than said predetermined level.

9. The method of claim 8, wherein said printhead operating frequency is calculated to be proportional to the ink remaining in said supply of ink.

10. The method of claim 8, wherein said revised printhead operating frequency is lower than said initial printhead operating frequency when said volume of said supply of ink is lower than said predetermined level.

11. The method of claim 8, wherein the quality of said image formed on said print media degrades when said printhead is operated at said initial printhead operating frequency and said volume of said ink is below said predetermined level, and wherein said revised printhead operating frequency is calculated to improve said quality of said image formed on said print media when said volume of said ink is below said predetermined level.

12. The method of claim 8, wherein said ink jet apparatus has a printhead carrier for transporting said printhead at a predetermined carrier speed in a reciprocating manner in a bi-directional main scan direction over said print media; and wherein said printhead operates at an initial carrier speed associated with said initial printhead operating frequency; and wherein said printhead operates at a revised carrier speed associated with said revised printhead operating frequency, said revised carrier speed being slower than said initial carrier speed.

13. The method of claim 8, wherein said ink jet apparatus has a printhead carrier for transporting said printhead in at least one pass in a reciprocating manner in a bi-directional main scan direction over said print media, and wherein said printhead operates in a plurality of print quality modes, wherein said printhead makes a predetermined number of passes over said print media in each of said print quality modes, with higher quality print modes having more passes than lower quality print modes, and wherein said printhead operates in a higher quality print mode in said revised printhead operating frequency to increase the number of passes made by said printhead over said print media.

14. The method of claim 8, wherein said ink jet apparatus has a printhead carrier for transporting said printhead in at least one pass in a reciprocating manner in a bi-directional main scan direction over said print media and wherein said printhead makes a predetermined number of passes over said print media and said printhead is paused at least once between passes.

* * * * *